United States Patent [19]

Lu

[11] Patent Number: 4,862,576

[45] Date of Patent: Sep. 5, 1989

[54] METHOD FOR RESTRESSING AND LOCKING HHL ANCHOR

[76] Inventor: Hsi H. Lu, 4 Fl., No. 26, Alley 17, Lane 76, Ho-Ping E. Rd., Sec. 2, Taipei, Taiwan

[21] Appl. No.: 238,763

[22] Filed: Aug. 30, 1988

[51] Int. Cl.[4] ..... B21D 39/00

[52] U.S. Cl. ..... 29/452; 52/223 L; 254/29 A; 405/256

[58] Field of Search ..... 29/452, 402.01; 52/223 R, 223 L, 225; 254/29 A; 405/256, 243, 251, 252, 239

[56] References Cited

U.S. PATENT DOCUMENTS

| | | | |
|---|---|---|---|
| 2,827,770 | 3/1958 | Bakker | 405/256 X |
| 2,988,794 | 6/1961 | Gutt | 254/29 A X |
| 3,117,485 | 1/1964 | Jansen | 254/29 A X |
| 3,263,384 | 8/1966 | Middendorf | 254/29 A X |
| 3,778,869 | 12/1973 | Andrews | 52/223 L X |
| 3,787,957 | 1/1974 | Andrews | 29/452 |
| 3,844,023 | 10/1974 | Surribas et al. | 29/452 |
| 4,106,752 | 8/1978 | Roqueta | 254/29 A |
| 4,408,706 | 9/1977 | Ludvigson | 254/29 A X |
| 4,604,003 | 8/1986 | Francoeur et al. | 405/256 |

FOREIGN PATENT DOCUMENTS

| | | | |
|---|---|---|---|
| 2050970 | 11/1979 | Fed. Rep. of Germany | 254/29 A |
| 864170 | 3/1961 | United Kingdom | 254/29 A |

*Primary Examiner*—Charlie T. Moon

*Attorney, Agent, or Firm*—Ostrolenk, Faber, Gerb & Soffen

[57] ABSTRACT

A method for restressing and locking HHL anchor, comprising a bearing plate placed between a gripping wedge and ground, a bearing shell is mounted over and connects with a jack, a load cell and a nut in series, a jack rod is inserted within the jack and has its lower end threaded inside for engaging with the gripping wedge and then determines the tension of the strands, characterized by providing a tension rod with a lower threaded end outside engaging with the bore of gripping wedge and a upper polygonal convexity fitted with a polygonal concavity of an extension rod having a upper polygonal end and inserted within the upper portion of the jack, operating the jack and jack rod for forcing the gripping wedge upwards for restressing said tension strands, and then, while maintaining the wedge in the restressed position, using a wrench for turning the extension rod as well as the tension rod downwards until the end of the tension rod touches the surface of the bearing plate for obtaining 100% restressing of the strands and locking anchors.

1 Claim, 3 Drawing Sheets

METHOD FOR RESTRESSING AND LOCKING HHL ANCHOR

BACKGROUND OF THE INVENTION

The present invention relates to a method for restressing and locking HHL anchor, in which it can provide a more simple device for stressing, restressing and adjusting the anchor.

In order to maintain the strength of land in civil engineering work, an effective method is to pile land anchor into the land at an appropriate location. In prior art, the traditional anchor transfers the load downward from top of the fixed end. Since the hardened cement grout is much weaker in tension than in compression, the top-to-bottom load transferring mechanism tends to create cracks along the bond length of anchor and consequently may result in strand corrosion in the long run. And in the place where the geological stratums are stanstone, mudstone, schist, shale, meathering rock, fractured rock, gravel, sand slit, caly, etc., the prestress of the anchor are often increased or reduced to a dangerous range because of heavy rain and/or earthquake moving the surrounding earth. However, no appropriate method is available to restress the strength of anchor after the piling work and the defects in engineering work will still cause a great damage to the land structure I, the inventor, have invented a method and testing device for HHL land anchorage applied for U.S. patent on Jan. 7, 1988 with application Ser. No. 141,377, now abandoned. The said invention comprises a pulling force adjusting nut mounted onto an anchor head portion for testing its pulling force, a rigid central rod for connecting to the center of anchor, a supporting base, a jack and a load measuring means orderly mounted to the outer of the rigid rod. By means of the controlling of the jack, which drives the rigid rod to produce a upward pulling force, the pulling force of the land anchor can be determined. Although it can obtain the objective of restressing and testing, it is still not convenient in operation.

SUMMARY OF THE INVENTION

The present invention has a primary object to provide a method for restressing and locking HHL anchor to overcome the foregoing and disadvantage of known method.

It is another object of the present invention to provide a method for restressing and locking HHL anchor such that the strength of the anchor can be restressed and locked with more easier procedure and the prestress can be 100% transmitted to the under-reaming.

It is a further object of the present invention to provide a method for restressing and locking HHL anchor wherein the free anchor length and applied load on strand can be tested and determined by the following formula : $L=S\times A\times E/P$, where S is strand deformation of free anchor length, A is cross section area of a strand, E is elastic modulus of the strand, P is applied load on strands and L is free anchor length.

Other objects and advantages of the present invention will become apparent from a study of the following specification in conjunction with the accompanying drawings.

DETAILED DESCRIPTION OF THE PREFERRED EMBODIMENT

Figure 1:
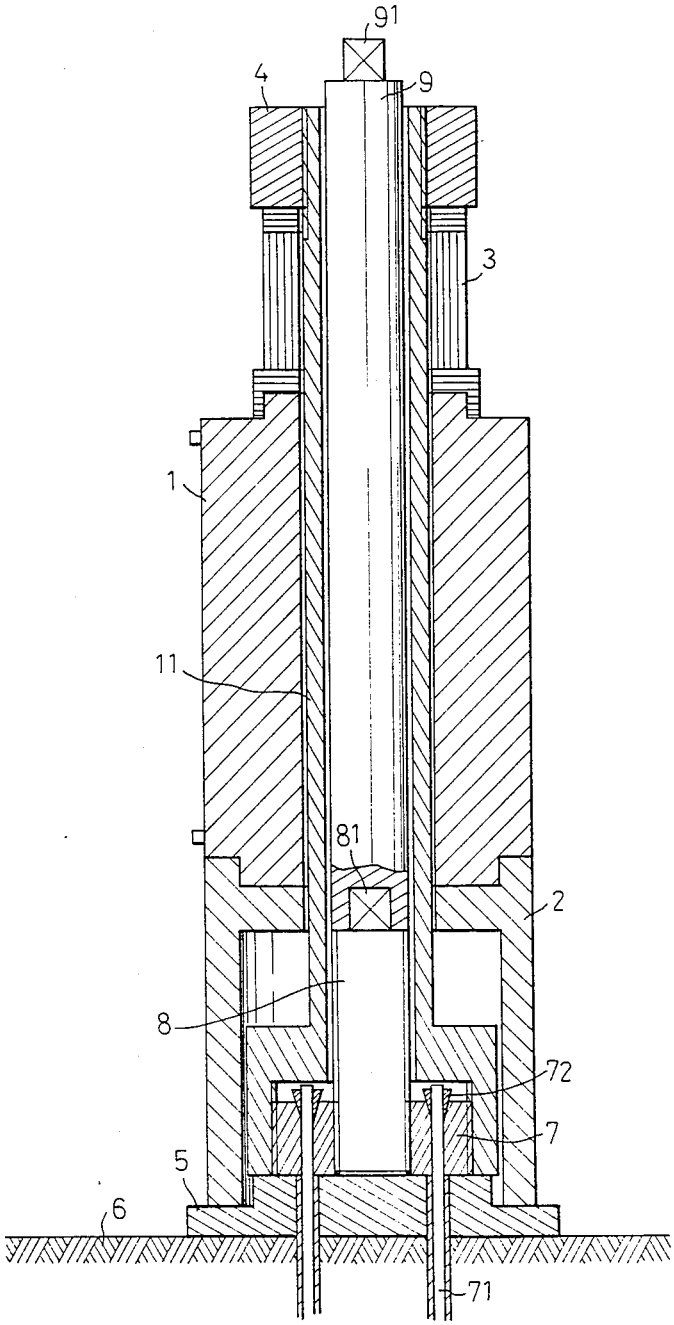
FIG. 1 is a cross-sectional view of the device in accordance with an embodiment of the present invention.

Referring now to the drawings, and particularly to FIG. 1, a device for HHL anchor according to the present invention is provided with a bearing plate (5) placed between a gripping wedge (7) and ground (6). The gripping wedge (7) is threaded outside and connects with several strands in axial direction which are fixed by respective fasteners 72 extended to the under-reaming. During restressing, it is provided with a bearing shell (2) over the gripping wedge (7) and mounted, in series, with jack (1), load cell (3) and nut (4) on the shell (2). While a jack rod (11) is pulled upward by the jack (1), the gripping wedge (7) which is connected within the jack rod (11) is forced upward and the tension of the anchor will be obtained at the balance point. As the said technique and principle are the same as the said Ser. No. 141,377 application and will not be described detailedly here.

Figure 2:
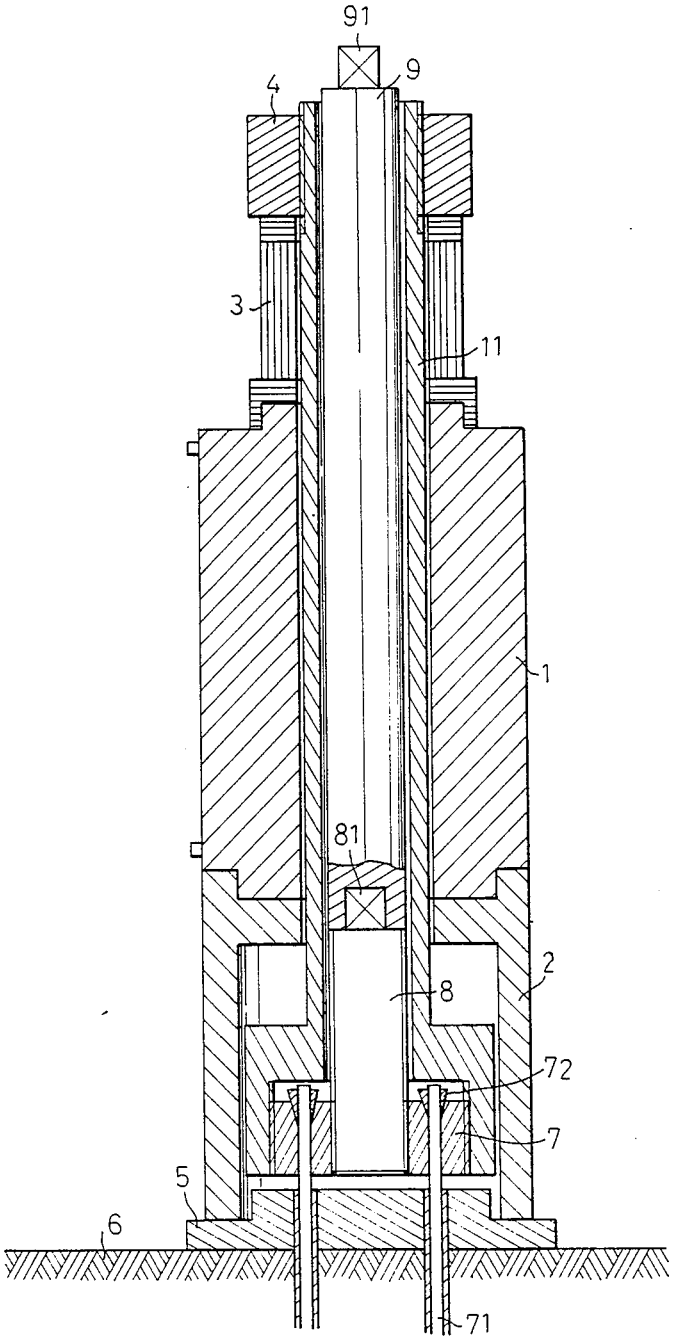
FIG. 2 is a cross-sectional view similar to FIG. 1 showing the anchor after restressing.
Figure 3:
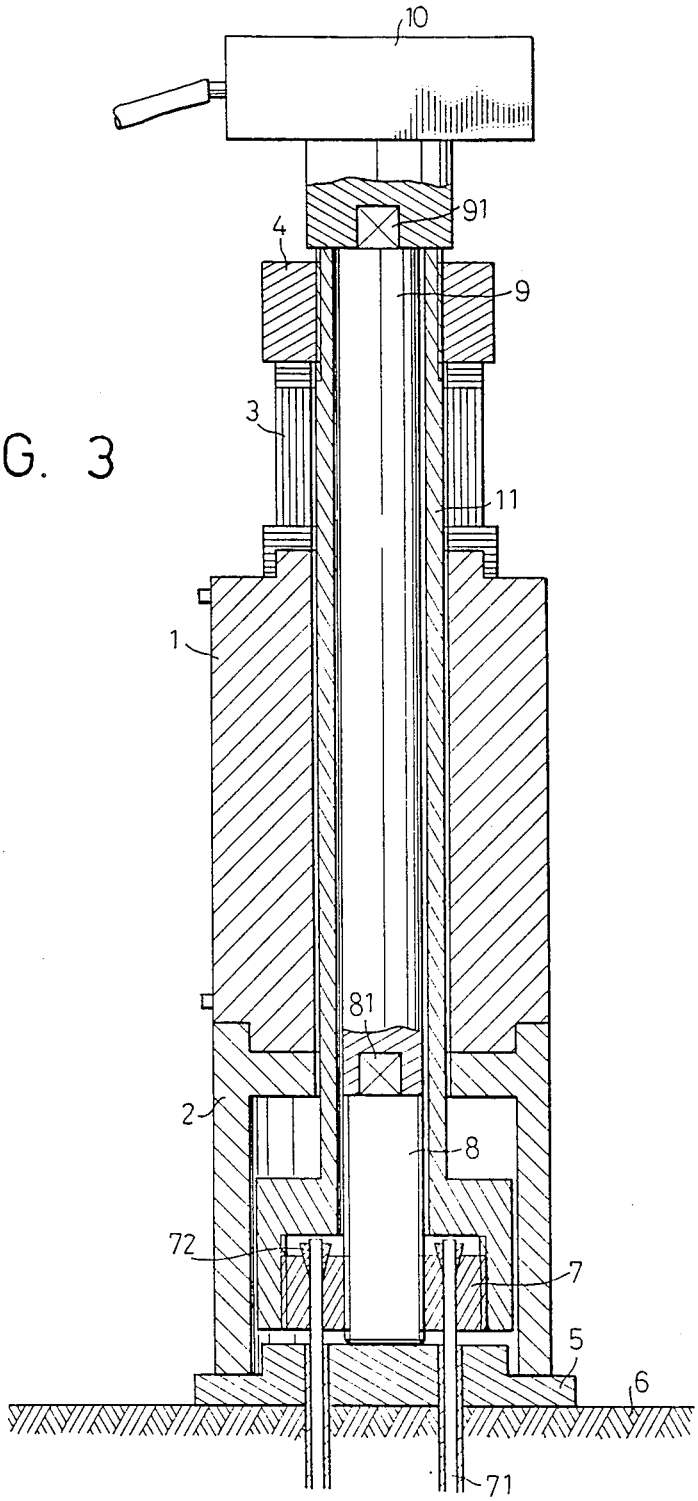
FIG. 3 is a cross-sectional view similar to FIG. 2 showing the anchor after locking.

The characteristic of the present invention provides a method which may restress the anchor after piling easier than ever before. As shown in FIG. 1, after the said apparatus is assembled, a tension rod (8) is inserted within the central hole of the jack rod (11) which has its bottom threaded outside connecting to the bore of the gripping wedge (7) and contacting to the surface of the bearing plate endly, and has a polygonal convexity (81) which engages with a polygonal concavity of a extension rod (9) inserted within the upper portion of the jack rod (11). When the tensions of the strands (71) are loose, it can use the jack (1) forcing the jack rod (11) as well as the gripping wedge (7) upward to obtain enough tensions (same as the prior application), as in the position of FIG. 2. Then, it can use an air wrench or wrench (10) which may fit with the upper polygonal end (91) of extension rod (9) for locking and turning until the end of the tension rod (8) touches the surface of the bearing plate again (as shown in FIG. 3). It is thus obtaining the purpose for restressing and locking an anchor so easily after relieving the said adjustive means including wrench, load cell, extension rod, jack, jack rod and bearing shell.

As mentioned above, the present invention has provided a more simple method for restressing and locking an anchor than any known design. While it can restress the tension of anchors and obviously increase the safety in engineering work.

Although the present invention has been described with a certain degree of particularity it is understood that the present disclosure is made by way of example only and that numerous changes in the detail and the combination and arrangement of parts may be resorted to without departing from the scope and spirit of the invention as herein after claimed.

I claim:

1. A method for restressing and locking HHL anchor, comprieses a bearing plate placed between a gripping wedge and ground, a bearing shell is mounted over and connects with a jack, a load cell and a nut in series, a jack rod is inserted within the jack and has its low end threaded inside for engaging with the gripping wedge and then determines the tension of the strands, characterized by providing a tension rod with a low threaded end outside for engaging with the bore of gripping wedge and a upper polygonal convexity which may be fitted with a polygonal concavity of an extent rod having a upper polygonal end and inserted within the upper portion of the jack, after forcing the gripping wedge upwards for restressing, using an air wrench or wrench turning the extent rod as well as the tension rod downwards till the end of the tension rod touches the surface of the bearing plate for obtaining 100% restressing and locking anchors.

* * * * *